US006099909A

United States Patent [19]

Rantanen et al.

[11] Patent Number: 6,099,909

[45] Date of Patent: Aug. 8, 2000

[54] METHOD AND DEVICE FOR COATING A SIZE-PRESS ROLL, PAPER, OR BOARD

[75] Inventors: Rauno Rantanen, Muurame; Hannu Korhonen; Markku Lummila, both of Jyväskylä; Timo Lintula, Keuruu, all of Finland

[73] Assignee: Valmet Paper Machinery, Inc., Helsinki, Finland

[21] Appl. No.: 08/065,182

[22] Filed: May 20, 1993

[30] Foreign Application Priority Data

May 21, 1992 [FI] Finland ..... 922331

[51] Int. Cl.[7] ..... B05D 3/12; B05C 11/02

[52] U.S. Cl. ..... 427/356; 427/359; 427/361; 118/110; 118/119; 118/414

[58] Field of Search ..... 427/355, 356, 427/359, 361; 118/100, 106, 107, 110, 117, 119, 414

[56] References Cited

U.S. PATENT DOCUMENTS

| | | | |
|---|---|---|---|
| 2,560,572 | 7/1951 | Haywood et al. | 427/428 |
| 2,676,563 | 4/1954 | Montgomery et al. | 118/227 |
| 4,848,268 | 7/1989 | Sollinger et al. | 118/227 |
| 4,869,933 | 9/1989 | Sollinger et al. | 427/356 |
| 4,889,073 | 12/1989 | Meinander | 427/356 |
| 4,981,726 | 1/1991 | Rantanen et al. | 427/356 |
| 5,049,420 | 9/1991 | Simons | 427/428 |
| 5,122,396 | 6/1992 | Rantanen | 427/428 |
| 5,159,893 | 11/1992 | Rantanen | 118/227 |

FOREIGN PATENT DOCUMENTS

| | | |
|---|---|---|
| 30147 | 1/1959 | Finland . |
| 905624 | 5/1991 | Finland . |
| 911345 | 10/1991 | Finland . |
| 87096 | 8/1992 | Finland . |

OTHER PUBLICATIONS

Trends and Developments in Size Press Technology, Charles P. Klass, TAPPI Journal, Dec. 1990, pp. 69–75.

*Primary Examiner*—Brian K. Talbot
*Attorney, Agent, or Firm*—Steinberg & Raskin, P.C.

[57] ABSTRACT

The invention relates to a coating method and device for coating a size-press roll, paper or board or a corresponding moving base. The coating device comprises a revolving coating bar which rests against the moving base and extends across the machine width. The coating bar is supported in a cradle substantially over its entire length and is a large-diameter grooved bar fitted against the moving base. The coating bar spreads and smoothes a coating agent onto the moving base. The coating agent is introduced into the coating device in advance of the coating bar in the running direction of the moving base.

17 Claims, 3 Drawing Sheets

METHOD AND DEVICE FOR COATING A SIZE-PRESS ROLL, PAPER, OR BOARD

BACKGROUND OF THE INVENTION

The invention relates to a method and device for coating a size-press roll, paper or board or a corresponding moving base, comprising a revolving coating bar which rests against a moving base extending across the machine width. The coating bar is supported in a cradle substantially over its entire length, and is arranged to spread and to smooth a coating agent onto the moving base. The coating agent is introduced into the coating device and onto the moving base in advance of the coating bar in the running direction of the moving base.

The invention also relates to a coating device for coating a size-press roll, paper or board or a corresponding moving base, comprising a coating-agent chamber, which is defined by a revolving coating bar, a front wall of the coating-agent chamber, lateral seals of the coating device, and the moving base. A coating agent is fed into the coating-agent chamber under pressure to thereby provide a pressurized coating-agent chamber. The coating bar is supported on, i.e., rests against, the moving base, and functions as the coating member. The coating bar extends across the width of the machine to thereby coat the entire width of the moving base.

The present invention further relates to a method for coating a size-press roll, paper or board or a corresponding moving base.

At present, in the coating processes for coating paper or board, two alternative methods and devices are commonly used, i.e., a blade coating technique or a bar coater technique. The present invention provides an improvement on the latter bar coaters, which have generally proved excellent especially in film size press techniques. The material commonly used in coating bars currently in use is usually steel. In order to increase the service life of the bar, the bars are provided with chromium plating.

In surface sizing techniques of paper, the face of the bar is provided with grooves, or steel wire may be wound onto the bar to form a texture similar to grooves on the bar face. The use of a grooved bar for surface sizing of paper is based on the fact that the thickness of the size film applied onto the base being coated is determined by means of the depth of the grooves.

It is a very significant drawback of grooved bars known in the prior art that they are prone to wearing quite rapidly. This wear reduces the service life of the bars and causes undesirable standstills to replace the worn bars.

Another drawback of prior art coating bars is that pigmenting with a high dry solids content is also entirely impossible with grooved bars, because the wear of the bars is excessive when used in conjunction with a pigmenting process.

The diameters of the coating bars currently in use are relatively small, generally about 10 mm. This specific diameter is representative of a small-diameter coating bar. Besides the wear of the coating bar, it is a further significant detrimental factor with the use of small-diameter bars that, especially in size-press operation, the roll faces are scratched excessively. The scratching results from the characteristic that the nip between the coating bar and the roll coating is quite open (not sufficiently wedge-shaped). Therefore, contaminants from the paper or size cannot be easily passed through this open nip. These contaminants, when remaining in front of the nip, form grooves in the roll coating and, at the same time, also cause the bar to wear locally.

Further, in the operation of size-presses, it is preferable to use roll coatings softer than normal, i.e., having a hardness of an order of about 35 P&J. In such a case, the contaminants have better access through the nip between the coating bar and the roll coating without producing scratches in the roll coating. This results from the fact that the contaminants are pressed into the soft coating.

When small-diameter bars are used in a bar coating technique, it is a further significant drawback that, when the bars are handled, they tend to undergo permanent distortions, after which they cannot be used any more. Likewise, web breaks frequently also bend and twist the bars permanently rendering the bars unusable.

In bar coaters utilizing large-diameter bars, these problems have not occurred when such bars are provided with a smooth-face for use in pigment-coating operation.

With respect to the prior art, reference is made further to Finnish Patent No. 30,147.

OBJECTS AND SUMMARY OF THE INVENTION

An object of the present invention is to provide a new and improved device by whose means the drawbacks related to prior art devices are substantially eliminated.

It is another object of the present invention to provide a new and improved bar coating technique by means of which a significant improvement is achieved in particular in surface-sizing and pigmenting of paper.

It is yet another object of the present invention to provide a new and improved bar used in a bar coater which is not prone to wearing rapidly to thereby increase the service life of the bar.

It is still another object of the present invention to provide a new and improved grooved coating bar which can be used in a pigmenting process with paper or board having a relatively high dry solids content.

In view of achieving these objects, and others that will come out later, the present invention comprises a coating device in which a large-diameter grooved bar is fitted against the moving base. The coating bar has a diameter of at least about 18 mm and a hollow interior. The shape of the coating bar is tubular and the grooves are arranged in the outer surface of the tube.

It is an important advantage of the present invention over prior art coating techniques that, by means of a coating device in accordance with the invention utilizing a large-diameter grooved coating bar, it is possible to run coating pastes having a high dry solids content even at high running speeds without causing excessive wear of the bars. In particular, by utilizing soft roll coatings, it is possible to substantially avoid scratching of the roll coatings. In this manner, in the device in accordance with the invention, the level of the coating quantity and the profile of the coating have been excellent and much better than results achieved in prior art techniques.

In a method in accordance with the invention, a loading pressure is applied against a large-diameter revolving coating bar of a coating device such that the coating bar is fitted against a moving base. The coating bar extends in a transverse direction across a width of the moving base and has a diameter of at least about 18 mm. A coating agent is applied from the coating device, and possibly from a pressurized coating-agent chamber in the device, onto the moving base in the running direction of the moving base before the coating bar. The coating bar is supported substantially over its entire length by means of a cradle. The coating agent is spread and smoothed on the moving base by the coating bar. Importantly, the coating bar is provided with grooves on an outer surface thereof which are open in a direction toward the moving base.

In a size-press incorporating a coating device in accordance with the invention, the moving base is a roll provided with a soft roll coating having a hardness of about 35 P&J. A coating paste having a high dry solids content is used as the coating agent such that scratching of the roll and excessive wear of the coating bar are substantially prevented.

Further advantages and characteristic features of the invention will come out from the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
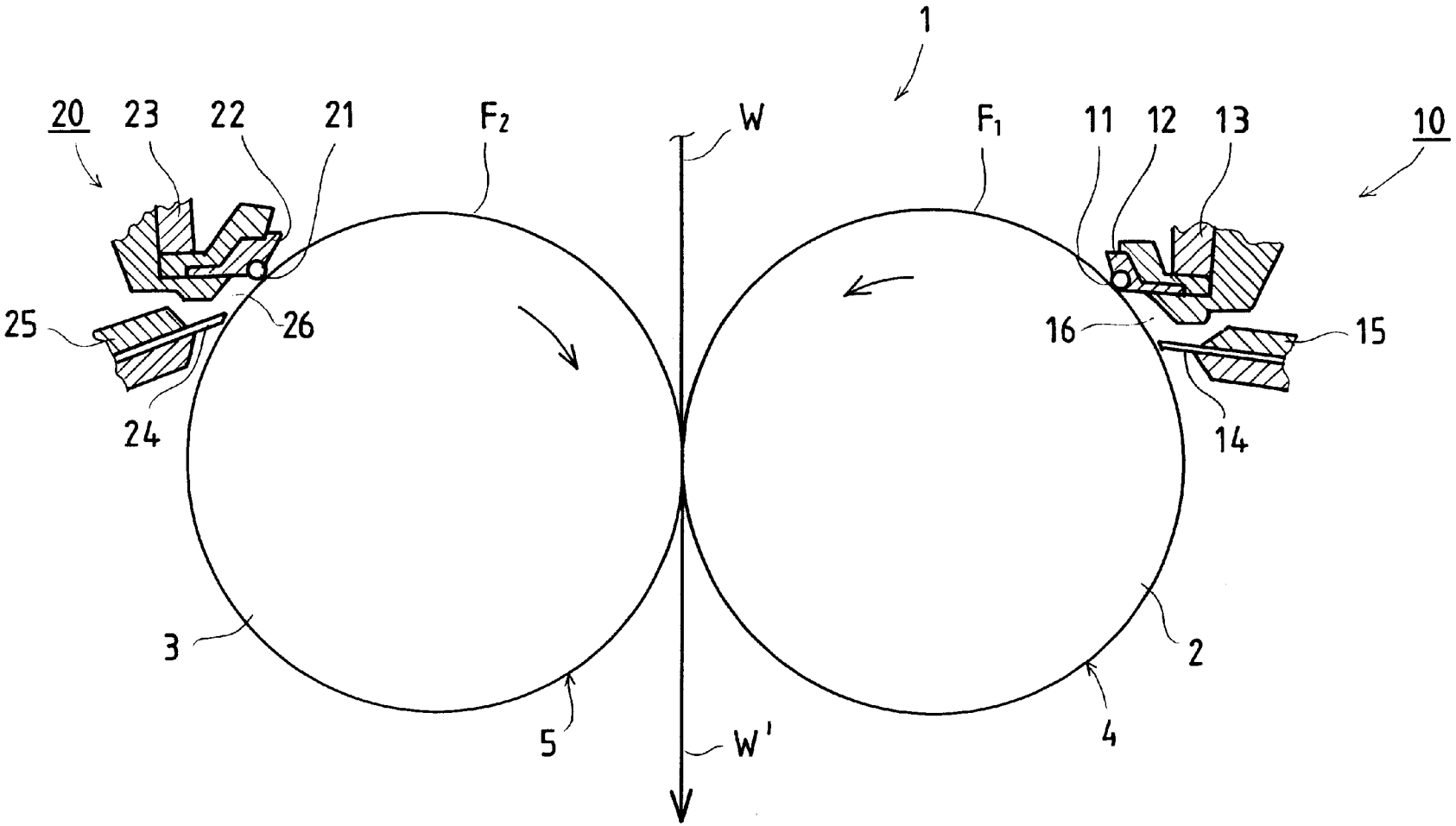
FIG. 1 is a schematic side view of a film size press utilizing a coating device in accordance with the invention and used in a method in accordance with the invention.

FIG. 1 is a schematic illustration of a film size press, which is denoted generally with reference numeral 1. The film size press 1 comprises a pair of rolls 2 and 3 of the size press, so that the first roll 2 and the second roll 3 form a nip N with one another. A paper or board web W is passed through the nip N. In the film size press 1, a first size film $F_1$ is metered onto the face 4 of the first roll 2 by means of a first coating device 10 and, in a corresponding way, a second size film $F_2$ is metered onto the face 5 of the second roll 3 by means of a second coating device 20. In the roll nip N, the size films $F_1$ and $F_2$ are transferred to the paper or board web W running through the nip. In FIG. 1, the coated web is denoted with reference W'. Thus, the metering of size films $F_1$ and $F_2$ onto faces 4 and 5, respectively, constitutes a premetering step with respect to the metering of the size films $F_1$ and $F_2$ onto the board or paper web.

In the film size press 1 shown in FIG. 1, the coating devices 10 and 20 are arranged such that the size films $F_1$ and $F_2$ are spread onto the faces 4 and 5 of the size press rolls 2 and 3, respectively. The size films are spread by bar coaters which are equal to one another as shown in FIG. 1.

The coating devices 10 and 20 are preferably coating devices of the so-called short-dwell type, in which the coating agent is introduced into a pressurized coating-agent chamber 16,26 placed before the coating bar 11,21 in the running direction of the moving base. The coating agent chamber is defined by the coating bar 11,21, the roll faces 4,5, a front wall 14,24 of the coating-agent chamber, as well as by lateral seals, if any (not shown). The coating bar 11,21 is fitted in a cradle 12,22 made of a suitable material, e.g., polyurethane. The cradle supports the coating bar 11,21 substantially over its entire length. The coating bar rests against a moving base having a machine width and extends in a direction substantially along the machine width. The coating bar 11,21 is provided with a purposeful drive gear (not shown), by whose means the coating bar 11,21 is rotated in a direction opposite to the direction of rotation of the correspond rolls 2,3. Further, in FIG. 1, the holders of the cradles of the coating bars 11,21 are denoted with reference numerals 13 and 23, respectively, and the holders of the front walls 14,24 with reference numerals 15 and 25, respectively. Loading means, i.e., an ordinary loading hose or equivalent, (not shown) are arranged between the coating-bar 11,21, cradle 12,22 and the holder 13,23. By means of the loading hose, the coating bar 11,21 can be loaded against the roll face 4,5 to produce a desired loading pressure.

According to the invention, in the coating devices 10,20 shown in FIG. 1, a large-diameter grooved coating bar 11,21 is used. The coating bar 11,21 in accordance with the invention is grooved and the diameter of the coating bar 11,21 is substantially larger than in prior art devices. Thus, in a coating device in accordance with the invention, the diameter of the coating bar 11,21 is at least about 18 mm, and very good results have been obtained in test runs with a coating device in which the diameter of the coating bar was about 35 mm. Most advantageously, the diameter of the bar is from about 25 mm to about 80 mm. A bar having a diameter larger than 25 mm is preferably made of a tube having a hollow interior. The coating bar will thus comprise an outer mantle having a tubular shape and surrounding the hollow interior.

Figure 2:
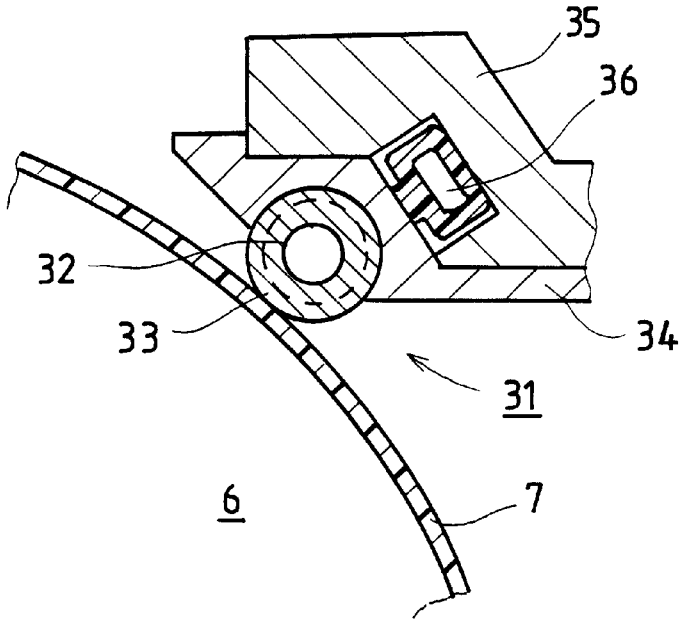
FIG. 2 is an enlarged and simplified illustration of an embodiment of a coating bar used in the coating device and method in accordance with the invention.

FIG. 2 shows an alternative embodiment by whose means an advantageous coating technique can be carried out by utilizing a grooved large-diameter coating bar in accordance with the invention. In FIG. 2, the size-press roll is denoted with reference numeral 6. The roll 6 is provided with a coating 7 in a conventional manner, which coating is, e.g., rubber or equivalent.

For achieving beneficial results of the invention, the most appropriate hardness of the coating face 7 of the roll 6 is from about 15 to about 100 P&J. The term "P&J" denotes the hardness of a coating measured in the Pusey & Jones scale with a Pusey & Jones plastometer.

In FIG. 2, the coating bar in accordance with the invention is denoted with reference numeral 31, and, in the embodiment of FIG. 2, the coating bar 31 comprises a tube 32 whose diameter is, e.g., in the range of about 35 mm. The interior of the tube 32 is hollow. The tube 32 is provided with suitable grooves 33 by whose means the coating quantity is determined.

In the embodiment of FIG. 2, the coating bar 31 is mounted revolvingly in a cradle 34 fabricated from, e.g., polyurethane, and supports the coating bar substantially over its entire length. The cradle 34 is attached to a holder 35, and a loading hose 36 or an equivalent loading member is arranged between the holder 35 and the cradle 34. By means of the loading hose 36, the coating bar 31 can be loaded in the desired manner against the roll 6 and, if necessary, the bar can be profiled by means of local differences in load.

In a preferred embodiment, the coating 7 of the roll 6 is a soft roll coating having a hardness of about 35 P&J and the coating agent applied onto the roll 6 is a coating paste having a dry solids content, possibly even a relatively high dry solids content. In this manner, scratching of the roll 6 and excessive wear of the coating bar 31 are substantially prevented.

Figure 2A:
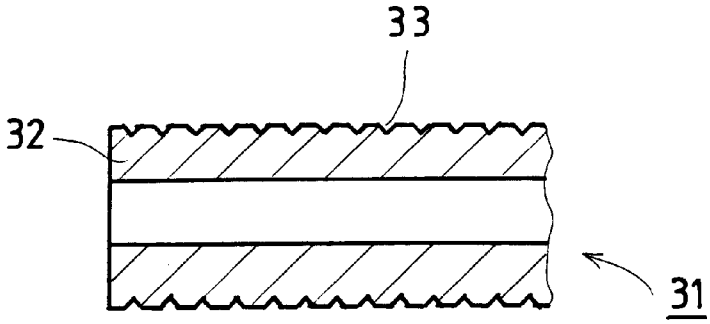
FIG. 2A is a schematic sectional view of an alternative embodiment of the groove geometry of a coating bar used in a coating device and method in accordance with the invention.

FIG. 2A illustrates one groove geometry of a coating bar 31 or the tube 32 that forms the coating bar. The grooves are denoted with reference numeral 33. The material of the tube 32 may be, e.g., chromium-plated copper or steel. The grooves 33 are open in a direction towards the moving base to be coated and may be equally spaced over the entire length of the coating bar 31. The grooves 33 may also be indented at a certain uniform depth into the coating bar 31 or tube 32. However, the grooves 33 may also be provided with a variable depth and/or spacing arrangement depending on the desired loading profile. The thickness of the size film applied onto the base being coated is determined by means of the depth of the grooves 33. The grooves 33 may also be a spiral groove or radial grooves arranged on substantially the entire length of the tube 32.

Figure 3:
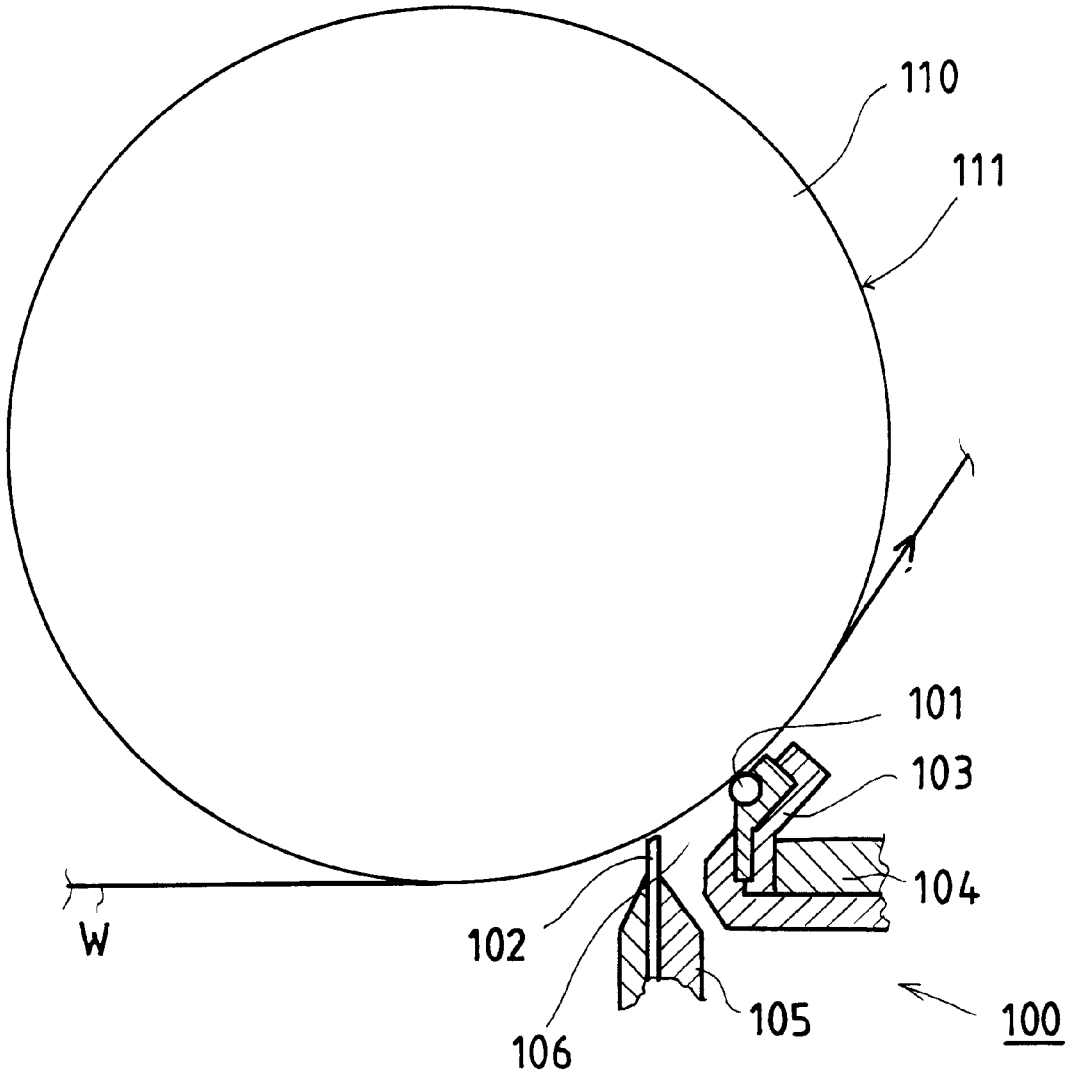
FIG. 3 is a schematic side view of an embodiment of the invention used in a coating process wherein a coating is applied directly onto a paper or board web.

The embodiment shown in FIG. 3 illustrates a coating technique in which the coating is applied directly onto a paper or board web W. In FIG. 3, the roll is denoted with reference numeral 110. The paper or board web W is passed over a roll face 111, and the coating is carried out by means of the coating device 100 directly onto the web W. The coating device 100 is a coating device of the so-called short-dwell type, which includes a large-diameter grooved coating bar 101, in accordance with the invention, mounted revolvingly in a cradle 103. The cradle 103 is mounted on a holder 104 in a standard manner, such as described above. The coating bar 101 defines the pressurized coating-agent chamber 106 together with a front wall 102 of the coating device 100. A coating agent is introduced into the chamber 106 before the coating bar 101 in the running direction of the web. The front wall 102 is mounted on a holder 105 in a conventional manner.

In test runs that have been carried out, excellent results have been obtained with a coating device in accordance with the invention. The test runs were carried out using an embodiment in which a grooved coating bar having a diameter of about 35 mm was mounted revolvingly in a coating-bar cradle of a conventional construction. The coating device constructed in this manner was arranged in a size press. Further, by means of the device, test runs were carried out with pigmenting. In some test runs, when a highly abrading pigment, e.g., calcined kaolin, was used in the pigmenting size, a grooved bar of a diameter of about 10mm was substantially worn during a wear test of about 10 hours so that it became unusable because of excessive wear of the bar.

However, when a bar of an equivalent construction and having a diameter of about 35 mm was utilized in a wear test carried out in the same way, there was no wear of the bar that could be readily noticed. This represented a substantial improvement over the 10 mm bar. In several test runs, it was also noticed that the larger the diameter of the bar is, the less scratching of the roll in size press operation. Thus, an improvement is achieved by means of the coating bar in accordance with the present invention in that the wear of the roll and scratching of the roll are reduced leading to an increase in the service life of the coating bar.

The examples provided above are not meant to be exclusive. Many other variations of the present invention would be obvious to those skilled in the art, and are contemplated to be within the scope of the appended claims.

We claim:

1. A coating device for coating a size-press roll, paper, board or a surface of a moving object, comprising a large-diameter revolving coating bar resting against a moving base having a machine width, said coating bar extending substantially along the machine width and having a tubular shape, a hollow interior, a diameter of at least about 18 mm and grooves on an outer surface thereof, said grooves opening in a direction toward said moving base, a cradle for supporting said coating bar substantially over its entire length, and means for applying a coating agent onto said moving base in advance of said coating bar in a running direction of said moving base, said coating bar being structured and arranged to meter the coating agent onto said moving base, said grooves have a variable depth and/or spacing arrangement such that a desired loading profile is obtained.

2. The device of claim 1, further comprising loading means for loading said coating bar against said moving base to produce local differences such that a desired profile of said coating bar is obtained.

3. The device of claim 1, wherein the diameter of said coating bar is in a range of between about 25 mm and about 80 mm.

4. The device of claim 1, wherein said coating bar is formed from chromium-plated copper or steel.

5. The device of claim 1, wherein said moving base comprises a roll of a size press, said roll being provided with a coating having a hardness of from about 15 P&J to about 100 P&J.

6. The device of claim 1, wherein said grooves are radial grooves.

7. The device of claim 1, wherein said grooves are spiral grooves.

8. A device for coating a size-press roll, paper, board or a surface of a moving object, comprising a large-diameter revolving coating bar resting against a moving base having a machine width, said coating bar extending across the machine width and having a tubular shape, a hollow interior, a diameter of at least about 18 mm and grooves on an outer surface thereof, said grooves opening in a direction toward said moving base, a cradle for supporting said coating bar substantially over its entire length, and means for applying a coating agent onto said moving base in advance of said coating bar in a running direction of said moving base, said coating bar being structured and arranged to meter the coating agent onto said moving base, said means comprising a coating-agent chamber having a front wall, said coating agent chamber being partially defined by said coating bar, said front wall and said moving base, the coating agent being fed into said coating-agent chamber under pressure, said grooves have a variable depth and/or spacing arrangement such that a desired loading profile is obtained.

9. The device of claim 8, further comprising loading means for loading said coating bar against said moving base to produce local differences such that a desired profile of said coating bar is obtained.

10. The device of claim 8, wherein the diameter of said coating bar is in a range of between about 25 mm and about 80 mm.

11. The device of claim 8, wherein said coating bar is formed from chromium-plated copper or steel.

12. The device of claim 8, wherein said moving base comprises a roll of a size press, said roll being provided with a coating having a hardness of from about 15 P&J to about 100 P&J.

13. The device of claim 12, wherein said coating of said roll is a soft roll coating having a hardness of about 35 P&J and the coating agent is a substantially dry coating paste, such that scratching of said roll and excessive wear of said coating bar are substantially prevented.

14. A method for coating a size-press roll, paper, board or a surface of a moving object, comprising the steps of:

providing a large-diameter revolving coating bar having a diameter greater than about 18 mm, said coating bar comprising a tube having a hollow interior, arranging said coating bar in a coating device, supporting said coating bar substantially over its entire length in a cradle, loading said coating bar against a moving base, said coating bar extending in a transverse direction across a machine width of said moving base, providing an outer surface of said coating bar with open grooves opening in a direction toward said moving base, applying a coating agent from said coating device onto said moving base in the running direction of said moving base before said coating bar, spreading and smoothing the coating agent on said moving base by means of said coating bar, and providing a variable depth and/or spacing arrangement of said grooves such that a desired loading profile is obtained.

15. The method of claim 14, further comprising introducing the coating agent into a pressurized coating-agent chamber in said coating device such that the coating agent is applied from said pressurized coating-agent chamber onto said moving base.

16. The method of claim 14, wherein said moving base is a roll, further comprising providing said roll with a soft roll coating having a hardness of about 35 P&J and using a substantially dry coating paste as the coating agent such that scratching of said roll and excessive wear of said coating bar are substantially prevented.

17. The method of claim 14, further comprising the step of metering the coating agent on said moving base by regulating the loading of said coating bar in the transverse direction to thereby regulate the quantity of the coating agent applied onto said moving base.

* * * * *